US005216191A

United States Patent [19]

Fox

[11] Patent Number: 5,216,191

[45] Date of Patent: Jun. 1, 1993

[54] SEMI-AUTOMATIC PISTOL

[75] Inventor: Geoffrey S. Fox, Burton on Trent, United Kingdom

[73] Assignee: Modern Manufacturing Company, Phoenix, Ariz.

[21] Appl. No.: 689,377

[22] Filed: Apr. 22, 1991

[30] Foreign Application Priority Data

May 10, 1990 [GB] United Kingdom ..... 9010475

[51] Int. Cl.[5] ..... F41A 17/56

[52] U.S. Cl. ..... 42/70.05; 89/150

[58] Field of Search ..... 42/70.04, 70.05, 70.08; 89/150

[56] References Cited

U.S. PATENT DOCUMENTS

| | | | |
|---|---|---|---|
| 1,741,281 | 12/1929 | Burton | 42/69.02 |
| 2,942,369 | 6/1960 | Emanuel | 42/70.08 |
| 3,195,408 | 7/1965 | Sherman | 89/195 |
| 3,724,113 | 4/1973 | Ludwig | 42/70.08 |
| 4,352,317 | 10/1982 | Wilhelm | 42/70.08 |
| 4,512,100 | 4/1985 | Dheur | 42/70.05 |
| 4,575,963 | 3/1986 | Ruger et al. | 42/70.08 |
| 4,854,217 | 8/1989 | Ransom | 89/196 |

FOREIGN PATENT DOCUMENTS

| | | |
|---|---|---|
| 751009 | 1/1935 | France . |
| 1148550 | 12/1957 | France . |

*Primary Examiner*—Michael J. Carone

*Attorney, Agent, or Firm*—Andrus, Sceales, Starke & Sawall

[57] ABSTRACT

A semi-automatic pistol has a slide which houses a barrel and a firing pin, and a frame which houses a trigger and a mechanism for releasing the firing pin. The mechanism includes a sear engageable with the firing pin and a cam actuator which is operable by the trigger. The cam actuator prevents movement of the sear to release the firing pin and also operates a detent to prevent movement of the firing pin, until the trigger has moved the cam actuator by a predetermined amount. The firing pin can also be locked in position by a safety catch which can act at the same time on a linkage between the trigger and the cam actuator, to disconnect the latter from the trigger. The operating characteristics of the trigger may be determined by selection of an actuator having a required profile. The firing pin is held captive in the slide and cannot be tampered with.

17 Claims, 7 Drawing Sheets

SEMI-AUTOMATIC PISTOL

This invention relates to a semi-automatic pistol and has as an object to provide such a pistol having improved ease of manufacture and improved safety.

The first of the above objects is achieved by providing, in a relatively fixed frame of the pistol, one or more sub-assemblies of components which are actuated to fire and/or recock the pistol, the, or each, sub-assembly being self-locating in the frame, whereby only one accurate location within the frame is necessary for each sub-assembly.

According to one aspect of the invention a semi-automatic pistol includes a frame and a slide, first and second sub-assemblies within said frame, said sub-assemblies coacting to fire and cock the pistol and each sub-assembly comprising an external housing which is a close fit in a complementary recess in said frame, and a plurality of components located in the housing for pivotal or sliding movement therein.

In a preferred embodiment one of said sub-assemblies includes a trigger and coacts with the other sub-assembly by way of a single component.

In a particular embodiment the other of said sub-assemblies includes a sear, a cam actuator for said sear, said single component linking said actuator to a trigger, means for disconnecting said component from said actuator, and means, coacting with said actuator, for limiting movement of a firing pin of the pistol.

The second of the above objects is achieved by means of a construction which ensures that the pistol will not fire, even when cocked and when loaded with a round, unless the trigger is pulled through at least two predetermined stages.

According to another aspect of the invention an automatic pistol comprises a frame and a slide, said frame containing a trigger, a cam actuator movable by said trigger, and a sear coacting with said actuator, said slide including a firing pin engageable by said sear, said cam actuator including a first portion engageable with said sear to prevent movement thereof out of engagement with said firing pin, and a second portion acting on said sear to disengage the latter from said firing pin only after movement of said actuator by said trigger to disengage said first portion from said sear.

In a preferred embodiment said actuator includes a third portion which coacts with said firing pin to prevent movement of the latter to a firing position unless said actuator is moved by said trigger.

A particular embodiment includes an element which is acted on by said third portion and is engageable with said firing pin to limit movement thereof, and said actuator is dimensioned so that said element is disengaged from said firing pin before said sear is disengaged from said firing pin.

A further particular embodiment includes a safety catch operable to lock said firing pin against movement and to uncouple said actuator from said trigger.

It is known that commercially available guns are frequently dismantled and reworked to provide characteristics required by a user. Such reworking is liable to render the guns less safe. It is a further object of the invention to provide a pistol in which such reworking will be apparent to a subsequent purchaser or to any enquirer into a mishap which involves the gun.

This further object is achieved by rendering at least one critical component of the pistol captive in such a way that its removal for modification will also require working of the part in which that component is housed.

In a further aspect of the invention a semi-automatic pistol comprises a frame and a slide, said slide including a guide for a firing pin and comprising two parts which cooperate to define said guide, said parts being bonded together at their joining surfaces to render said firing pin captive in said guide.

A particular embodiment includes a safety catch operable to lock said firing pin against movement and to uncouple said actuator from said trigger.

A pistol embodying the inventions will now be described by way of example only and with reference to the accompanying drawings, in which.

Figure 1:
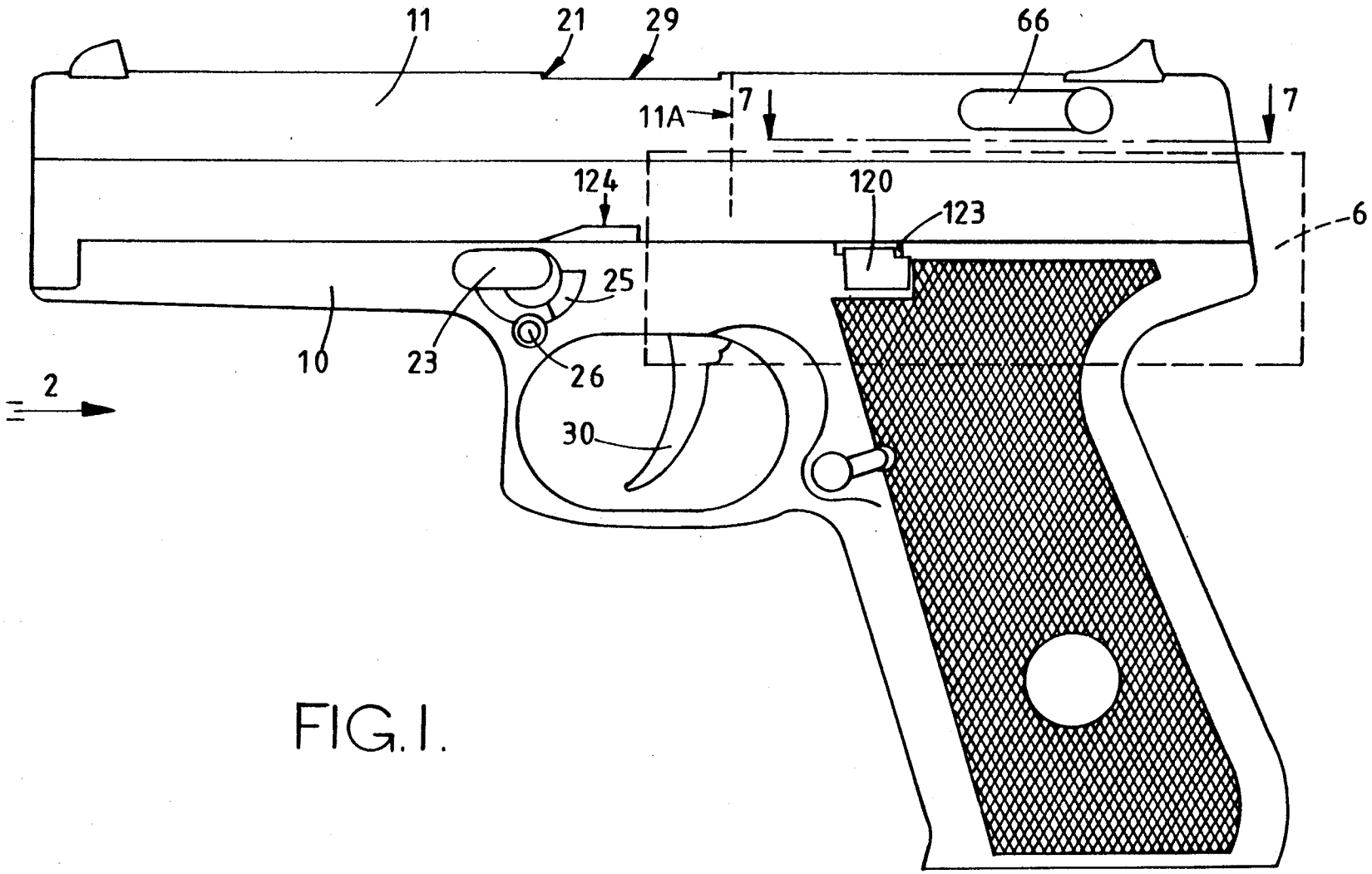
FIG. 1 is an external view of the pistol.
Figure 3:
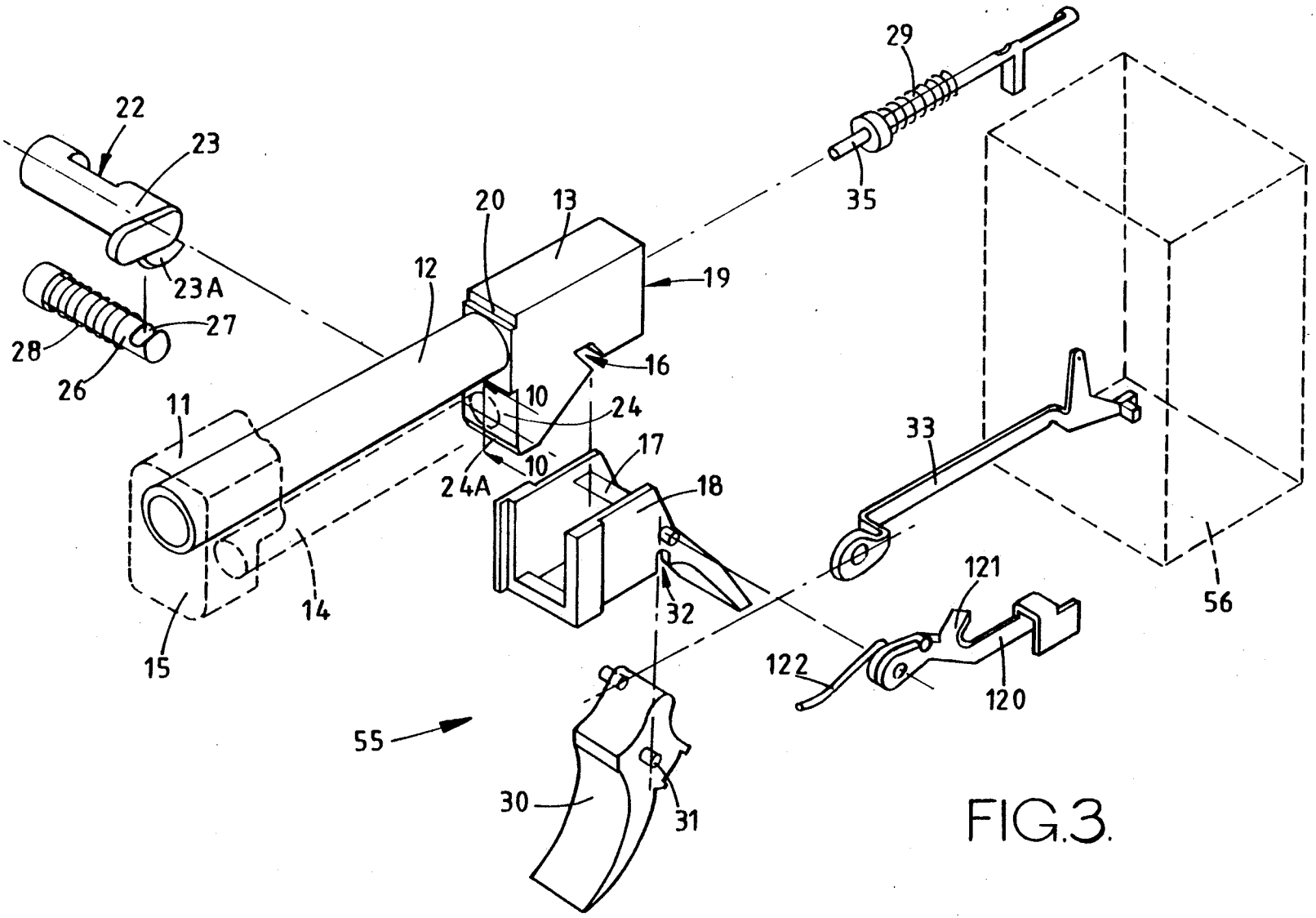
FIG. 3 is a pictorial exploded view of a part of the mechanism of the pistol.
Figure 4:
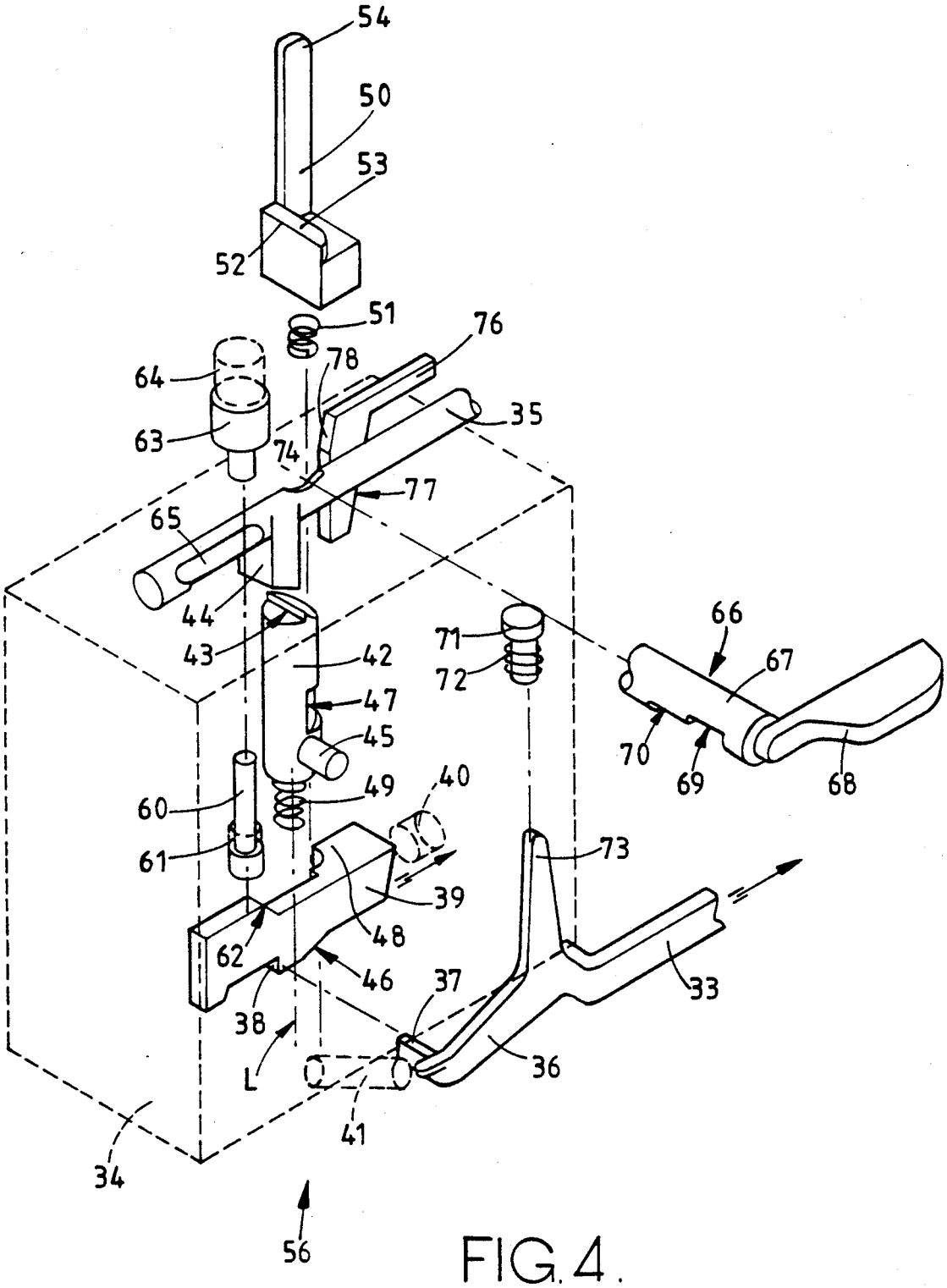
Figure 5:
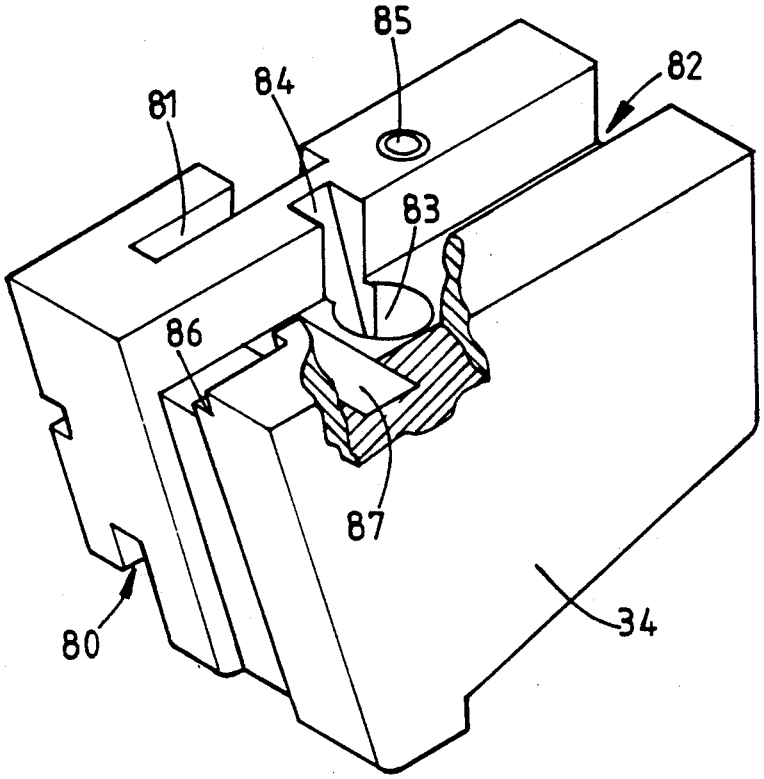
Figure 6:
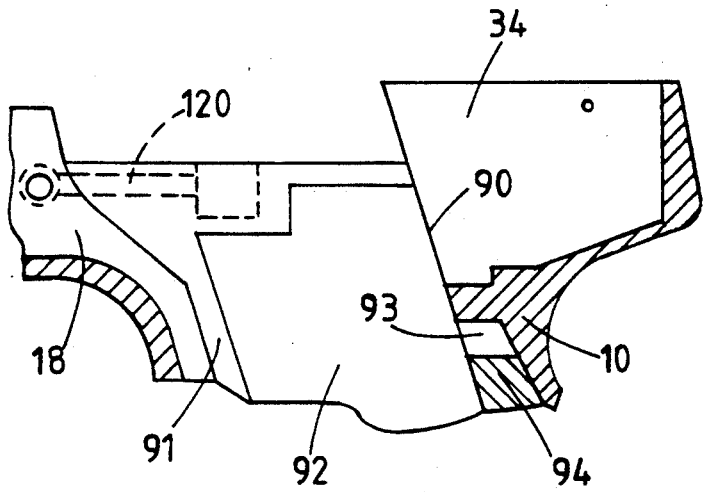
Figure 7:
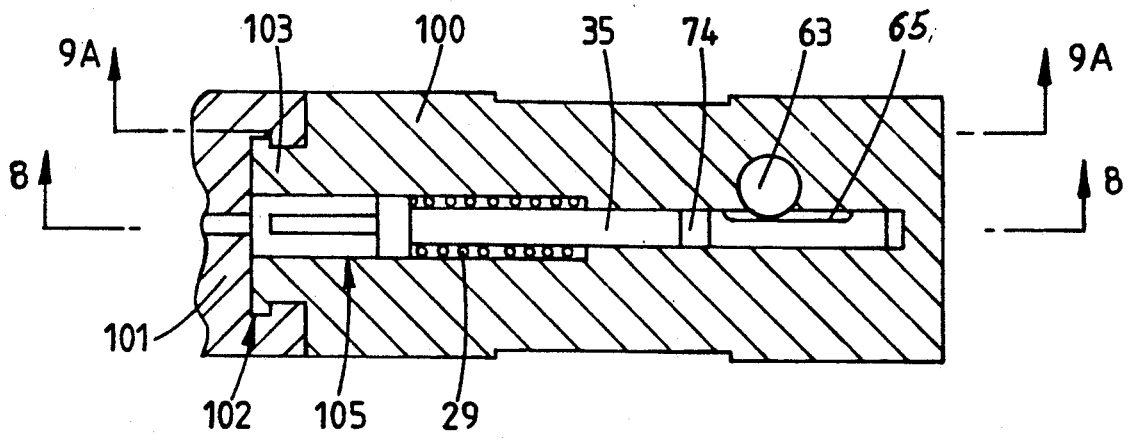
Figure 8:
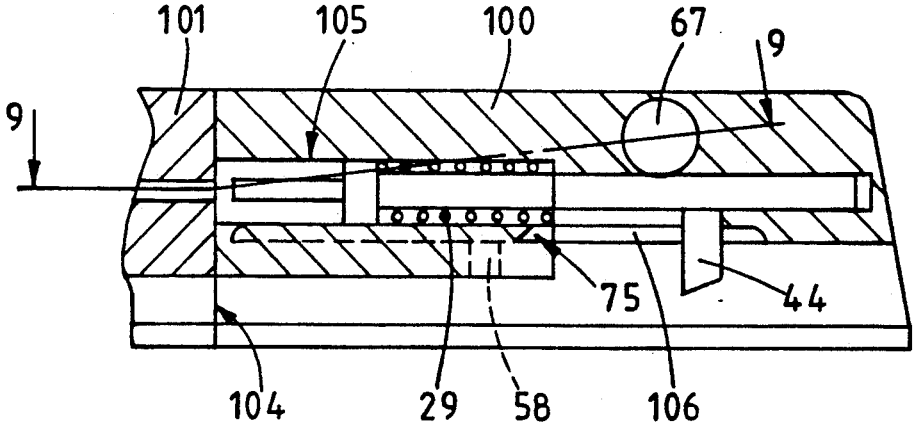
Figure 9:
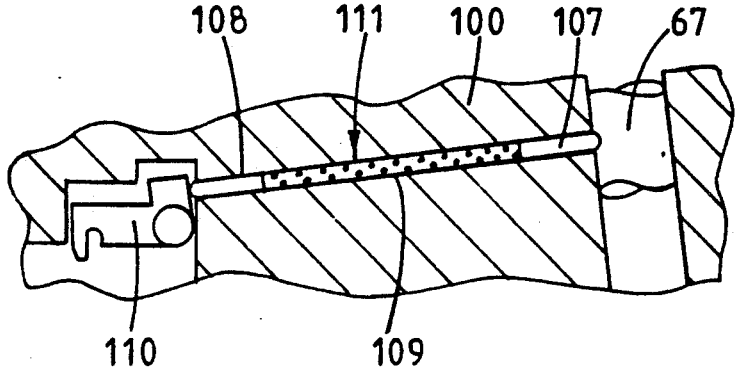
Figure 10:
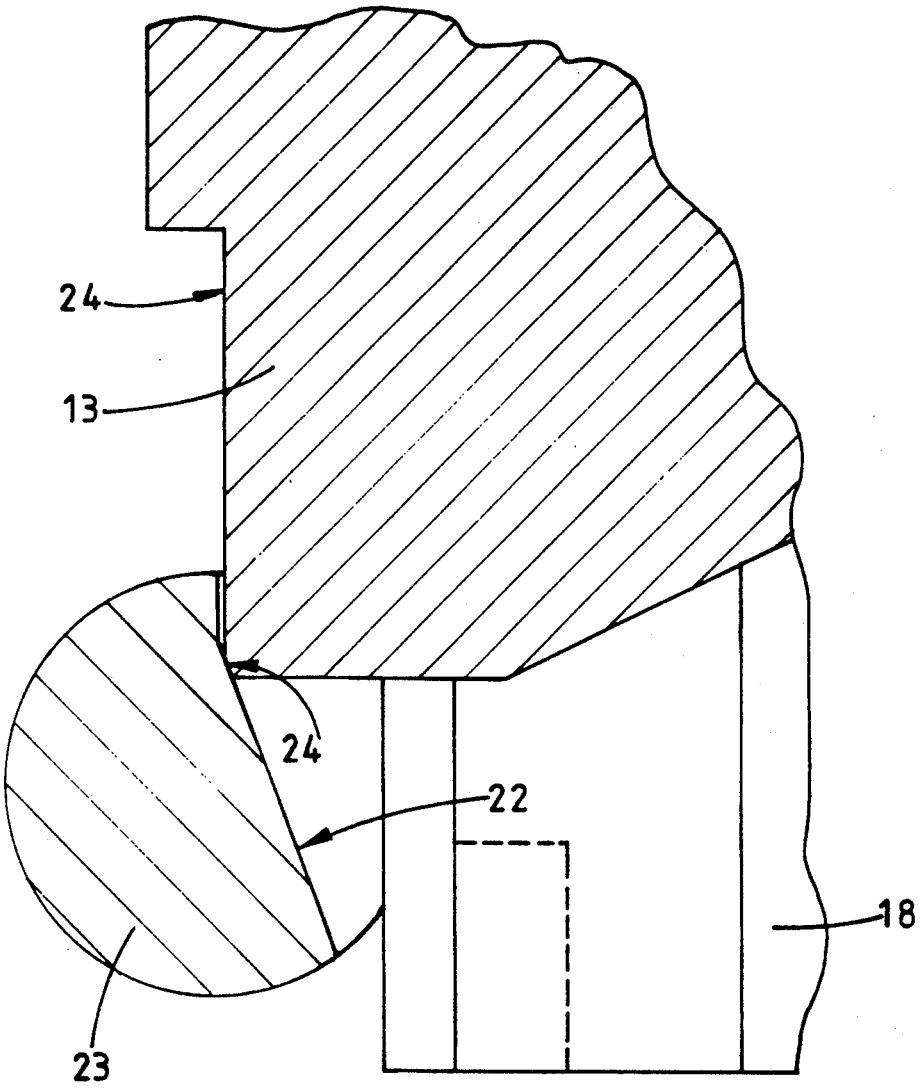

FIG. 4 is a pictorial exploded view, to an enlarged scale, of another part of the mechanism, and from a direction opposite to that of FIG. 3, FIG. 5 is a pictorial view of a block indicated diagrammatically in FIG. 4, FIG. 6 is a section through a part of a frame of the pistol, showing the location therein of parts shown in FIGS. 3 and 5, FIG. 7 is a section on line 7—7 in FIG. 1, FIG. 8 is a section on line 8—8 in FIG. 7, FIG. 9 is a section on line 9—9 in FIG. 8 and in the plane 9A—9A in FIG. 7, and FIG. 10 is a section, to an enlarged scale, on line 10—10 in FIG. 3.

In the following description the terms "forward" and "forwardly" relate to the direction of movement of a bullet fired from the gun. "Rearward" and "rearwardly" related to the opposite direction.

Figure 2:
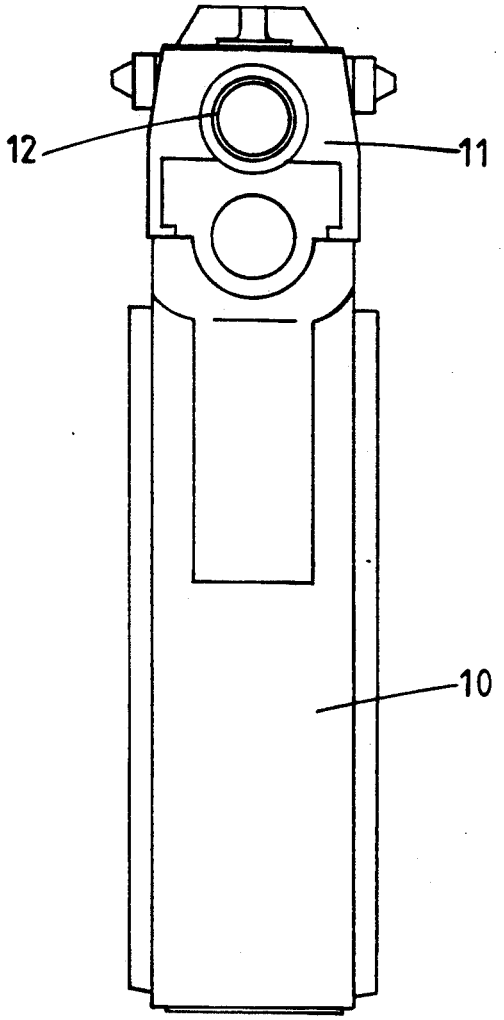
FIG. 2 is a view on arrow 2 in FIG. 1.

As shown in FIGS. 1 and 2 a semi-automatic pistol includes a frame 10 and a slide 11. As shown in FIG. 3 a barrel 12 is located within the slide 11 and includes at its breech end an integral block 13 which engages the frame 10 in a manner to be described. A compression spring 14 is engaged between the block 13 and a part 15 of the slide 11, to urge the latter to its most forward position. The lower face of the block 13 has an inclined, parallel-sided slot 16 which is engageable with a complementary bar 17 which extends between opposed internal faces of a cage 18 which is a close fit in a recess in the frame 10, the block 13 being a close fit between the aforesaid internal faces. At rest a rear face 19 of the block 13 abuts an opposing face 11A (FIG. 1) of the slide 11, and when the slide 11 is in its forward position a front face 20 of the block 13 abuts a face 21 (FIG. 1) of the slide 11. Forward travel of the slide 11 is limited by a flat 22 face of a catch 23 which is mounted on the frame 10 and is engaged by the face 24 of the block 13 which also engages the spring 14. The catch 23 has a portion 23A which can nest in a recess 25 (FIG. 1) in the frame 11, to prevent rotation of the catch 23. A plunger 26 is slidable in the frame 10 and has a groove 27 which is captive on the portion 23A, so that the plunger 26 is constrained to move axially with the catch 23. The plunger 26 is biassed by a spring 28 so as to engage the portion 23A of the catch 23 in the recess 25. The end of the catch 23 remote from its portion 23A projects from the frame 11 and can be depressed against the spring 28 to lift the portion 23A clear of the recess 25. The catch 23 can then be rotated to allow the block 13 to clear the flat 22 and the slide 11 thereby to be removed from the frame. The top face of the slide 11 has an opening 29 through which spent cartridge cases can be ejected. The face 24 includes a small bevel 24A, and in the retaining position of the catch 23 the flat face 22 thereon lies parallel to the face of the bevel 24A, as shown more clearly in FIG. 10.

The cage 18 also provides a pivotal mounting for a trigger 30 which has integral stub pivots 31 engaged in slots 32 in bottom edges of respective sides of the cage 18. The cage 18 and trigger 30 form a sub-assembly 55. Pivotally engaged with the trigger 30 is a trigger bar 33 which extends rearwardly of the frame 10 into a sub-assembly 56, indicated diagrammatically and in outline only. As described hereafter the sub-assembly 56 includes a block 34 having guideways and abutments for a plurality of components which act on a firing pin 35. The firing pin 35 is mounted in the slide 11 in axial alignment with the barrel 12 and is urged forwards by a spring 29.

The block 34 is shown in more detail in FIG. 5. FIG. 4 shows components forming the sub-assembly 56, as well as elements which coact with those components externally of the block 34. The rearward end of the trigger bar 33 has a cranked portion 36 whose extremity 37 engages an abutment face 38 on a cam actuator 39 which is axially slidable in the block 34 and is biased rearwardly of the pistol by a spring 40 The actuator 39 is offset from the vertical plane which passes through the firing pin 35. An extension spring 41 between the extremity 37 and the block 34 urges the trigger bar 33 rearwards, and its extremity 37 upwards A sear 42 is vertically slidable in the block 34, is biased upwards by a spring 49, and has a latching face 43 engageable with a tongue 44 on the firing pin 35. The sear 42 also has a transversely extending pin 45 which is engaged under a first cam face 46 of the actuator 39, so that forward movement of the actuator 39 by the trigger bar 33 urges the sear 42 downwardly to release the firing pin 35. The sear 42 also has an arcuate recess 47 which is engaged by a complementary projection 48 on the actuator 39 when the latter is in its rearward position, to maintain the latching face 43 of the sear 42 in engagement with the firing pin tongue 44. It will be apparent that the sear 42 can never move downwards to release the firing pin 35 until the actuator 39 has been moved sufficiently forward by the trigger bar 33 to enable the projection 48 to clear the recess 47 on the sear 42.

The form of the face 46, and to a lesser extent the force exerted by the spring 40, determine the pull required to be exerted on the trigger 30 in order to fire the gun. The form of the face 46 also determines the amount of trigger movement required to fire the gun. The trigger pull and movement may thus readily be selected by insertion of an actuator 39 whose face has a required form. It will be understood that the faces 46 may be planar and have a constant inclination to the line of action L of the sear 42, or may comprise a plurality of differently inclined portions. In one embodiment the face 46 may have a constantly decreasing inclination to the line of action L, whereby the force required to be applied to the trigger 30 will progressively increase until the firing pin 35 is released.

A locking plunger 50 for preventing rearward movement of the actuator 39 is vertically slidable in the block 34 and is biassed upwards by a spring 51. The plunger 50 has a portion 52 whose upper face 53 bears against the underneath face of the projection 48 of the actuator 39 in the rearward position of the latter. When the actuator 39 is in its forward position the portion 52 engages behind the projection 48 to maintain the latter its forward position. An upper end 54 of the plunger 50 is engageable by a part 75 (FIG. 8) of the slide 11 as the latter moves rearwardly, depress the plunger 50 and release the actuator 39.

A plunger 60 is biased by a spring 61 into engagement with a second cam face 62 of the actuator 39. A further plunger 63 is biased by a spring 64 into engagement with the plunger 60. In its downward position, corresponding to the rearward position of the actuator 39, the plunger 63 engages a recess 65 in the firing pin 35, limiting movement of the latter to prevent its contact with a round in the chamber of the barrel 12. The plunger 63 is lifted clear of the recess 65 only when the actuator 39 is moved a sufficient distance forward by the trigger bar 33. The relative positions of the projection 48 and cam faces 46, 62 on the actuator 39 are such that the projection 48 and plunger 63 are sequentially moved clear of the sear 42 and firing pin 35 respectively before the sear 42 is moved downwards to release the firing pin 35. The pistol can thus in no circumstances fire except following a sufficient movement of the trigger 30.

A safety catch 66 includes a spindle 67 which extends through the slide 11 and has levers 68 (only one of which is shown in FIG. 4) at its opposite ends, externally of the slide 11. The spindle 67 has two flats 69,70. The flat 69 is engageable by a stud 71 which is slidable in the slide 11 and is biased upwards by a spring 72. An upward projection 73 on the cranked end 36 of the trigger bar 33 is urged by the spring 41 into engagement with the stud 71. Rotation of the safety catch 66 away from the position shown in the drawing thus urges the rear end of the trigger bar 33 downwards to a position in which the extremity 37 can no longer engage the abutment face 38 of the actuator 39. In the position of the safety catch 66 shown in the drawing the flat 70 is clear of the firing pin 35. Rotation of the safety catch 66 away from that position causes the circumference of the spindle 67 to engage a recess 74 on the firing pin 35 and prevent movement of the latter. The safety catch 66 is thus operable both to disengage the trigger 30 from the sear mechanism and to lock the firing pin 35 in a safe position. As the slide 11 moves rearwards a portion 75 (FIG. 8) thereof engages the projection 73 on the trigger bar 33 to disconnect the latter from the actuator 39, and also engages the sear 42 to hold the latter down.

An ejector 76 is mounted in block 34 and has horizontal and downwardly extending portions. The downwardly extending portion has a longer front face 77 which is parallel to a shorter rear face 78. The ejector 76 is slidable into the block 34 in a direction parallel to the faces 77, 78 and lies with its top face level with the top face of the block 34.

FIG. 5 indicates the general form of the block 34, from the viewpoint of FIG. 3, and with a portion cut away to show details. The block 34 includes guideways 80, 81 for the trigger bar 33 and the upward projection 73 of the latter A groove 82 in the top face provides clearance for the tongue 44 of the firing pin 35 and for downwardly extending portions of the slide 11.

The sear 42 is slidable in a bore 83 which has a contiguous groove 84 to accommodate the pin 45 of the sear 42. A further bore 85 houses the plunger 60. A recess 86 houses the ejector 76 and opens on to the front face of the block 34 so that the top face of the ejector 76 can lie flush with the top face of the block 34. A slot 87 guides the plunger 50 and opens into a side of the groove 82 so that the upper end 53 (FIG. 4) of the strip 50 projects into the groove 82.

FIG. 6 shows the block 34 located as a close fit in a recess in the frame 10, the forward face of the block 34 engaging a wall 90 which defines a cavity 91 for receiving a magazine 92 for the pistol. The wall 90 also defines a cavity 93 within the frame 10, within which cavity 93 an electric storage battery 94 may be located. The battery 94 may be used to power a laser sighting device located within the spring 14 (FIG. 3), or any other electric device on the gun. As shown in FIGS. 7 and 8 the slide 11 is in two parts 100, 101. The part 101 being formed with a T slot 102 and the part 100 with a complementary projection 103. The major plane 104 at which the parts 100, 101 join lies on a step in a bore 105 in which the firing pin 35 slides. The pin 35 and its spring 29 may thereby be inserted into the bore 105 and held by the safety catch spindle 67 while to parts 100, 101 are joined. The mating surfaces of the parts 100, 101 are secured together by means of a suitable adhesive which has great shear strength. The firing pin 35 is thus captive within the slide 11, though accessible for cleaning and lubrication through an opening 106 through which the tongue 44 of the pin 35 extends.

As shown in FIG. 9 a bore 111 extends through the slide part 100 and supports plungers 107, 108 which are biased apart by a spring 109. The plunger 107 acts a detent for the safety catch spindle 67, and the plunger acts on a pivotally mounted extractor 110, which can engage the groove in a cartridge base and can also be lifted clear when a round of ammunition is inserted in the chamber.

Referring back to FIG. 3, a catch 120 is pivotally mounted on the cage 18 and has a projection 121 which extends transversely of the frame 10. The catch 120 is biased clockwise, as viewed in the drawing, by a spring 122, into engagement with a recess 123 (FIG. 1) in a side wall of the frame 10, in which position the projection 121 is clear of the slide 11. If the slide 11 is moved rearwardly to its full extent it may be retained in that position by lifting the catch 120 so that the projection 121 engages an abutment 124 on the slide 11. As indicated in FIG. 6 the catch 120 extends into the cavity 91 for the magazine 92. The catch 120 can therefore also be urged upwards by the magazine platform when the magazine 92 is empty. The slide 11 is thus retained in its rearward position after the last round in the magazine 92 has been fired.

When the gun is cocked the actuator 39 (FIG. 4) is in its rearward position and engaged by the trigger bar 33. The sear 42 is locked into engagement with the firing pin tongue 44 as a result of engagement of the sear recess 47 with the actuator projection 48. The plunger 63 engages the firing pin 35 to limit forward movement of the latter. When the trigger is pulled the actuator 39 is moved forward by the trigger bar 33 and releases the cutaway portion 47 of the sear 42 from the projection 48, releases the firing pin 35 from the plunger 63 and moves the sear 42 downwards to release the firing pin 35. The actuator 39 is locked in its forward position as a result of engagement of the arm 52 of the strip 50 behind the projection 48.

When the gun fires the barrel 12 and slide 11 move rearwards together for about 2.5 mm until the front edge of the slot 16 in the block 13 (FIG. 3) engages the bar 17 of the cage 18, urging the block 13 downwards over the next 1 mm approximately of its rearward movement, after which movement of the barrel 12 is arrested. Downward movement of the block 13 frees the face 20 thereof from the face 21 (FIG. 1) of the slide 11, allowing the latter to continue to move rearwards as a result of its momentum, and compressing the spring 14. The extractor 110 (FIG. 9) withdraws the cartridge case from the barrel 12 and the ejector 76 urges the case out through the opening 29 in the slide 11.

Continued rearward movement of the slide 11 causes its part 75 (FIG. 8) to engage the end 54 of the strip 50 and disengage the arm 52 thereof from the actuator projection 48, allowing the actuator 39 to move rearwards. The portion 75 (FIG. 8) of the slide 11 urges down the trigger bar 33 and the sear 42. Rearward movement of the slide 11 is arrested when the part 15 (FIG. 3) thereof abuts the frame 10 The slide 11 is then returned forward by the spring 14, allowing the sear 42 to move upwards and the actuator projection 48 to engage the sear recess 47. The trigger bar 33 is also allowed to move upwards to engage the face 38 of the actuator 39, provided that the trigger 30 has been released. The firing pin tongue 44 engages the latching face 43 of the sear 42 to recock the gun.

Forward movement of the slide 11 causes its face 11A (FIG. 1) to engage the rear face 19 of the block 13 (FIG. 3), moving the latter forwards. As shown in FIG. 10 the bevel 24A on the face 24 of the block 13 engages the flat 22 of the catch 23, urging the block upwards to disengage the slot 16 therein from the bar 17 in the cage 18.

If the gun is "dry fired", that is cocked and the trigger pulled with no round of ammunition in the chamber, the slide 11 will remain forward and the actuator 39 locked in its forward position by the strip 50. The trigger bar 3 cannot act on the actuator 39 and the gun is therefore inactive until manually recocked by pulling back and then releasing the slide 11.

In a particular embodiment the faces 46, 62 of the sear actuator 39 (FIG. 4) are planar and lie respectively at 3.15 and 50.8 degrees to the vertical. The planar nature of the face 46 results in a substantially constant pull force on the trigger 30 over its travel. The contour of the face 46 in other embodiments may be such as to provide any desired trigger pull force and release point. For example, if the face 46 is concave the pull force on the trigger 30 will increase progressively up to the release point. In all embodiments the angle of the face 62 will be matched to the contour of the face 46 so as to ensure that the plunger 63 clears the recess 65 before the sear 42 releases the firing pin. It will be apparent that a desired setting of trigger pull force or release point, or both, may be obtained merely by substituting one configuration of sear actuator 39 for another. Additionally, or alternatively, trigger pull force by itself may be varied by means of the sear actuator spring 40 alone.

I claim:

1. A semi-automatic pistol comprising a frame and a slide mounted on said frame, said frame containing a trigger, a cam actuator movable by movement of said trigger, and a sear coacting with said actuator, said slide including a firing pin engageable by said sear, said cam actuator including a first portion engageable with said sear to prevent movement thereof out of engagement with said firing pin, and a second portion acting on said sear in response to movement of said actuator by said trigger to disengage said sear from said firing pin only after movement of said actuator by said trigger to disengage said first portion from said sear.

2. A piston as claimed in claim 1 in which said second portion comprises a face whose inclination to a line of action of said sear is selected to provide a desired force and distance of pull of said trigger to effect movement of said actuator sufficient to cause release of said firing pin by said sear.

3. A piston as claimed in claim 2 in which said face has a plurality of inclinations to the line of action of said sear.

4. A piston as claimed in claim 1 in which said cam actuator includes a third portion which coacts with said firing pin to prevent movement of the latter to a firing position unless said actuator is moved by said trigger.

5. A piston as claimed in claim 4 which includes an element which is acted on by said third portion of the cam actuator and is engageable with said firing pin to limit movement thereof, and said actuator is dimensioned so that said element is disengaged from said firing pin before said sear is disengaged from the firing pin.

6. A pistol as claimed in claim 1 which includes a safety catch which is operable to lock said firing pin against movement and to uncouple said actuator from said trigger.

7. A pistol as claimed in claim 6 which includes a connector bar coupled to said trigger and having a part engageable with an abutment of said cam actuator, said safety catch being operable to prevent engagement of said part with said abutment.

8. A pistol as claimed in claim 1 which includes a spring biassing said cam actuator against movement by said trigger, and a locking element engageable with said actuator to retain the latter in a forward position to which it has been moved by operation of said trigger.

9. A pistol as claimed in claim 8 in which said locking element is engageable by said slide as the latter moves rearwardly, to move said locking element out of engagement with said actuator.

10. A pistol as claimed in claim 8 in which said sear and said cam actuator are mounted in a first housing for sliding movement therein along mutually perpendicular axes.

11. A pistol as claimed in claim 10 in which said locking element comprises a plunger slidable in said first housing.

12. A pistol as claimed in claim 10 in which said first housing is fit in a recess in said frame.

13. A pistol as claimed in claim 10 in which said trigger is pivotally mounted on a second housing which is fit in a recess in said frame.

14. A piston as claimed in claim 13 in which a part of said second housing can engage a face which is carried by a barrel of said piston and which is inclined to the axis of said barrel.

15. A piston as claimed in claim 14 in which said barrel includes a block which is fit between opposed internal faces of said second housing and which has abutment faces engageable with respective opposed faces of said slide.

16. A semi-automatic pistol comprising a frame and a slide mounted on said frame and supporting a barrel and a firing pin, first and second sub-assemblies mounted in first and second housings, said housings fitting in respective recesses in said frame, said first sub-assembly including a trigger which coacts with said second sub-assembly by way of a linkage between said housings, said second sub-assembly including a sear engageable with said firing pin, said second sub-assembly further including means engaging said sear for preventing said sear from releasing said firing pin until said trigger has been pulled by a predetermined amount.

17. A piston as claimed in claim 16 in which said second sub-assembly includes means engaging said firing pin for preventing movement of said firing pin to a firing position until the trigger has been pulled by a predetermined amount.

* * * * *

UNITED STATES PATENT AND TRADEMARK OFFICE

CERTIFICATE OF CORRECTION

PATENT NO. : 5,216,191

DATED : June 1, 1993

INVENTOR(S) : Geoffrey S. Fox

It is certified that error appears in the above-identified patent and that said Letters Patent is hereby corrected as shown below:

Claim 2, column 6, line 67, delete "piston" and substitute therefor --pistol--;

Claim 3, column 7, line 5, delete "piston" and substitute therefor --pistol--.

Claim 4, column 7, line 8, delete "piston" and substitute therefor --pistol--.

Claim 5, column 7, line 12, delete "piston" and substitute therefor --pistol--.

Claim 14, column 8, line 11, delete "piston" and substitute therefor --pistol--.

Claim 14, column 8, line 13, delete "piston" and substitute therefor --pistol--.

Claim 15, column 8, line 15, delete "piston" and substitute therefor --pistol--.

UNITED STATES PATENT AND TRADEMARK OFFICE

CERTIFICATE OF CORRECTION

PATENT NO. : 5,216,191

DATED : June 1, 1993

INVENTOR(S) : Geoffrey S. Fox

It is certified that error appears in the above-indentified patent and that said Letters Patent is hereby corrected as shown below:

Claim 17, column 8, line 33, delete "piston" and substitute therefor --pistol--.

Signed and Sealed this

Eleventh Day of January, 1994

Bruce Lehman

*Attest:*

BRUCE LEHMAN

*Attesting Officer*

*Commissioner of Patents and Trademarks*